United States Patent [19]

Köhnen et al.

[11] Patent Number: 4,617,988

[45] Date of Patent: Oct. 21, 1986

[54] SOOT BLOWER FOR THE REMOVAL OF DEPOSITS FROM SURFACES OF HEAT EXCHANGERS OR THE LIKE

[75] Inventors: Klaus Köhnen, Mülheim; Hans Niermann; Norbert Ullrich, both of Essen, all of Fed. Rep. of Germany

[73] Assignee: Krupp-Koppers GmbH, Essen, Fed. Rep. of Germany

[21] Appl. No.: 594,772

[22] Filed: Mar. 26, 1984

[30] Foreign Application Priority Data

Apr. 8, 1983 [DE] Fed. Rep. of Germany ..... 3312599

[51] Int. Cl.[4] ..... F28G 1/16

[52] U.S. Cl. ..... 165/95; 122/390; 122/392

[58] Field of Search ..... 165/95; 122/381, 384, 122/390, 392, 405, 391

[56] References Cited

U.S. PATENT DOCUMENTS

| | | | |
|---|---|---|---|
| 3,269,366 | 8/1966 | Caracristi et al. | 122/392 |
| 3,273,543 | 9/1966 | Petit | 122/392 |
| 4,204,503 | 5/1980 | Reilly et al. | 122/392 |
| 4,456,057 | 6/1984 | Melcer | 165/95 |

FOREIGN PATENT DOCUMENTS

| | | | |
|---|---|---|---|
| 202281 | 6/1956 | Australia | 165/95 |
| 288830 | 4/1928 | United Kingdom | 122/392 |

*Primary Examiner*—Sheldon J. Richter
*Attorney, Agent, or Firm*—Michael J. Striker

[57] ABSTRACT

A soot blower for the removal of deposits collected on the surfaces of walls forming a chamber, through which gases containing solid particles flow, is integrated in one of the walls which form that chamber. The feeding pipes of the blower for feeding a blowing agent into the chamber are formed in the region of the line which defines the outer face of that wall.

16 Claims, 8 Drawing Figures

SOOT BLOWER FOR THE REMOVAL OF DEPOSITS FROM SURFACES OF HEAT EXCHANGERS OR THE LIKE

BACKGROUND OF THE INVENTION

The present invention relates to a soot blower for the removal of solid deposits collected on the surfaces of chambers through which gases flow. Such chambers can be provided in heat exchangers, reaction vessels or the like.

Soot blowers of the type under consideration are known. Such soot blowers are either stationarily installed in the chamber or space, through which gases flow, or are periodically inserted into that chamber for cleaning the interior of that chamber. The removal of deposits collected on the walls forming the chamber is carried out by means of a gas or steam-forming blowing medium, for example nitrogen or water steam which is fed through the soot blower and is discharged therefrom through bores or nozzles which spread the streams of blowing medium onto the inner side of the wall forming the chamber or onto the surfaces of the tubes or tube bundle arranged in that chamber. Deposits collected on the surfaces of the tubes of the heat exchanger or the like are here particles loosely positioned on the tube surfaces and which stick to the walls or surfaces to form a cake thereupon.

Known soot blowers have, however, some disadvantages. One of known soot blowers is a rotary tubular blower which is rigidly installed in the chamber of the reaction vessel or the heat exchanger and is therefore subjected to high temperatures of gases flowing through the chamber; this soot blower is therefore subject to erosion and corrosion because solids which are contained in flowing gases have corrosive constituents. This causes a premature damage and thus replacement of the soot blower by a new one, which leads to a stoppage of the operation.

In the case of the soot blower periodically inserted into the chamber of the reaction vessel or the heat exchanger the problem is that during the introduction and removal of the streams of the blowing medium onto and from the surfaces of the tube assembly of the heat exchanger those streams strike against not only the surfaces to be cleaned but also against all the surfaces of the tubes which leads to intensive wear. Further disadvantages of the known soot blower are a relatively large space required therefor in the chamber and the problem of sealing of the chamber due to periodical insertions and removals of the soot blower from the chamber.

Particularly if the soot blower operates in the chamber exposed to high pressures of gases the sealing problem becomes enormous because rotating and movement-translating elements of the soot blower must be sealed against high pressure gases. Even with a penetration of a small quantity of high pressure gases into the soot blower the latter must be replaced by a new one which leads to considerable costs in the removal of deposits from the surfaces of the tubes of the heat exchanger.

SUMMARY OF THE INVENTION

It is an object of the present invention to provide an improved soot blower which would avoid the above noted disadvantages of conventional soot blowers.

It is a further object of the invention to provide a soot blower which could be efficiently employed with gases of low pressures and high pressures as well.

These and other objects of the invention are attained by a soot blower for the removal of deposits from walls forming a gas-contained chamber of a heat-exchanger, reaction vessel or the like, comprising means for feeding a blowing medium into said chamber, said blower being integrated with one of the walls forming said chamber.

The feeding means may include a plurality of feeding pipes, said wall having an outer face defined by a straight alignment line, said feeding pipes being positioned in the region of said alignment line.

The feeding pipes may be positioned before the alignment line as viewed from said chamber or behind that alignment line.

The walls forming the chamber may be formed of a plurality of adjacent tubes connected to each other, each of said feeding pipes having a nozzle directed into an interior of said chamber and formed in said wall.

The wall of the chamber integrally connected to the blower, may be formed of a plurality of adjacent tubes connected to each other, each of said feeding pipes including at least one nozzle tube extended through said wall and terminated with a nozzle directed into an interior of said chamber.

Said wall may be a straight wall, said feeding pipes being arranged outside of said wall and each include at least one nozzle tube projected from the pipe and extended through said wall and open into an interior of said chamber. Said wall in another modification of the invention may be a double wall formed of two straight walls spaced from each other, said feeding pipes being arranged outside of said double wall and each including at least one nozzle tube projected from the associated pipe and extended through said double wall and open into an interior of said chamber.

Each feeding pipe may be provided with an additional nozzle tube, one of the straight walls of the double wall having an inner face facing the interior of said chamber, said additional nozzle tube having an end which is flush with said inner face.

Each of the feeding pipes may have closeable discharge openings for blowing away solid particles collected in the pipes.

The feeding pipes may be spaced from each other along said wall whereby the removal of deposits in a vertical direction of the chamber is carried out by switching on of a number of individual feeding pipes one after another.

The removal of deposits in a horizontal direction of the chamber may be carried out by parallel switching on of a number of individual feeding pipes.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
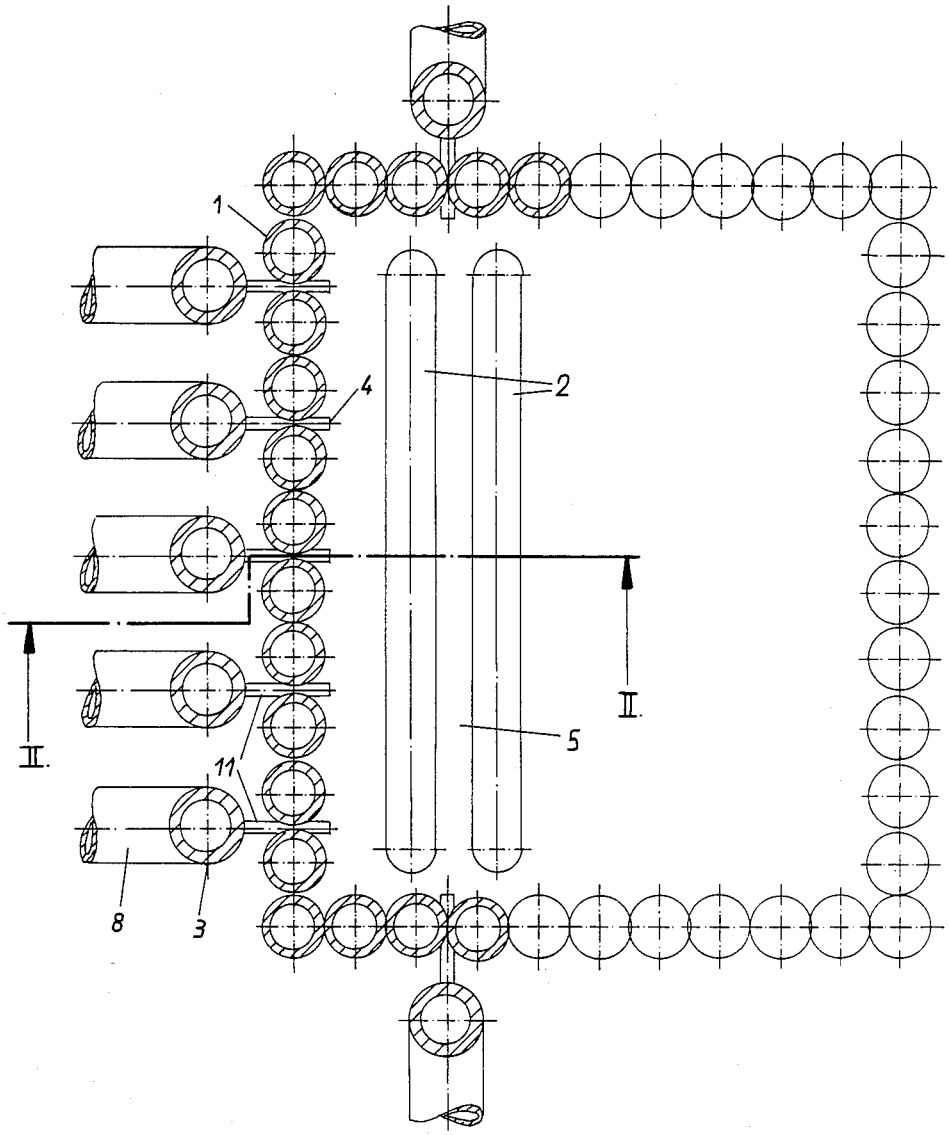
FIG. 1 is a top plan view, partially in section, of a heat exchanger with tubular walls and a built-in tube assembly.

Referring now to the drawings in detail, FIG. 1 illustrates a heat exchanger formed by a tubular wall 1 which is comprised of a plurality of adjacent tubes welded to each other along their longitudinal sides. This tubular wall encloses a substantially rectangular space or chamber in which horizontally extended tubes or pipes 2 are located. Pipes 2 form in the exemplified embodiment the heat exchanger, in the interior of which gases, for example hot combustion gases or synthesis gases flow.

Figures 2, 2A:
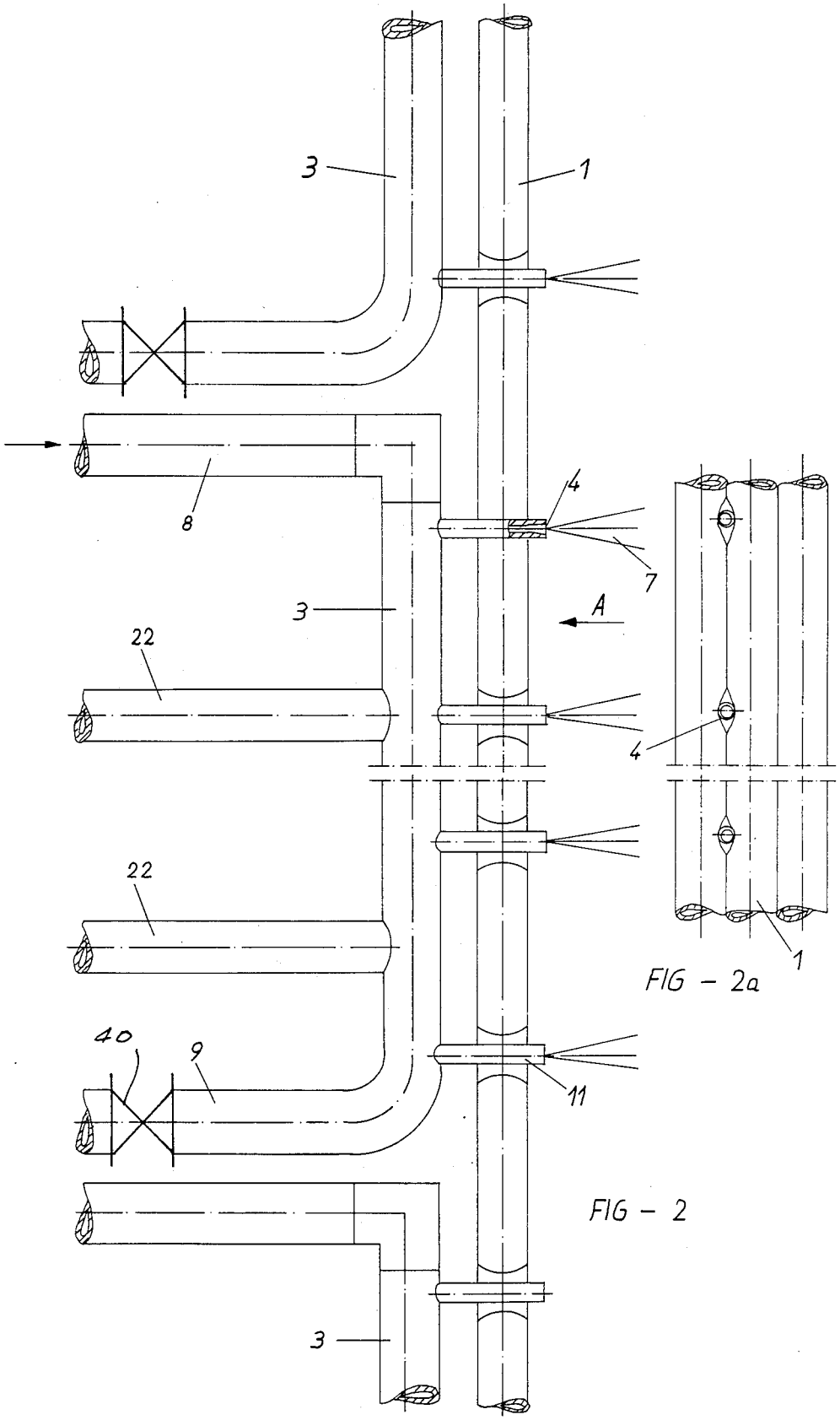
FIG. 2 is a sectional view taken along line II—II of FIG. 1.
FIG. 2*a* is a view seen from arrow H of FIG. 2.

A soot blower according to the invention is combined with the tubular wall 1 so that a number of parallel feeding pipes 3 for a blowing medium extend in the horizontal direction and parallel to the tubes forming the wall 1. Feeding pipes 3 are spaced from each other and are arranged behind the wall 1. Nozzle tubes 11 extend from feeding pipes 3 through wall 1 into the closed space formed by peripheral wall 1. Each feeding pipe 3 is provided with a number of nozzle tubes 11 distributed over the length of the pipe 3 as shown in FIG. 2 and terminated with nozzles 4. Nozzle tubes 11 and corresponding nozzles 4 are arranged so that streams of blowing gases discharged from the nozzles spread between the individual pipes 2 of the tube bundle as well as in interspaces between the pipes positioned one above another. Thereby solid particles, which are originated from the above mentioned hot gases and found on the pipes of the pipe assembly 2 are blown from the surfaces of pipes 2 with the streams of inflowing gases.

Figure 3:
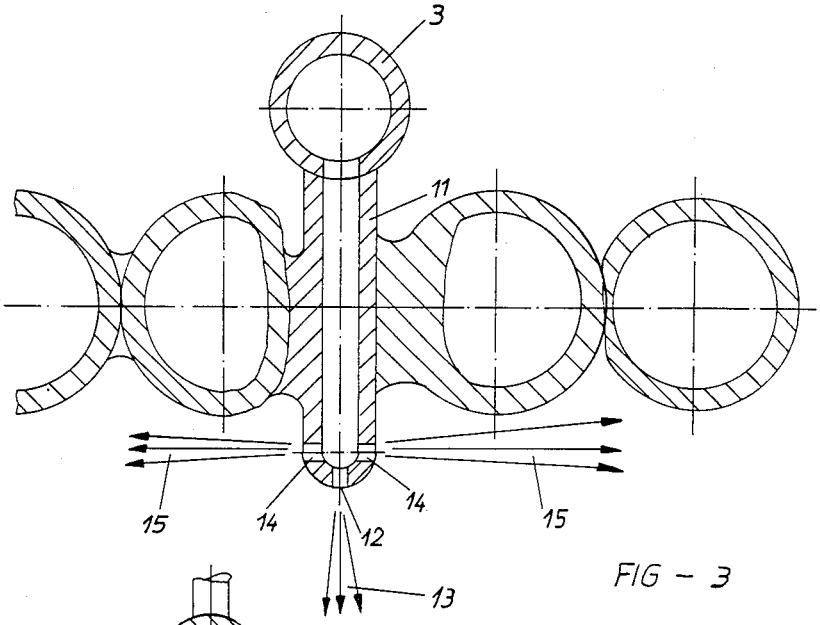
FIG. 3 is a sectional view of a feeding tubular arrangment for a blowing medium, mounted behind an alignment line of the heat exchanger (tube-to-tube arrangement)
Figure 3A:
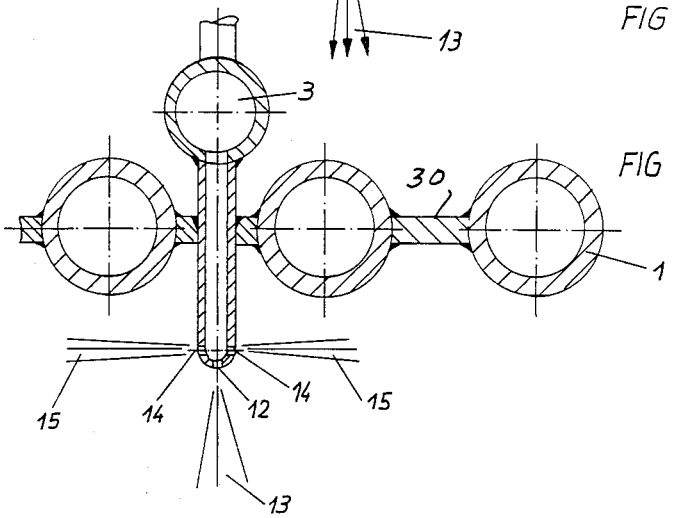
FIG. 3*a* is a sectional view corresponding to that of FIG. 3 but for a tube-web-tube arrangement.

FIGS. 2 and 3*a* further illustrate the arrangement of the soot blower which is comprised of feeding conduits 8 and feeding pipes 3 for a blowing medium, nozzle tubes 11, nozzles 4 and discharge conduits 9 with shut-off devices 40 which can open the feeding system for cleaning. The arrangement shown in FIGS. 1, 2 and 2*a* is designed so that streams of blowing gases discharged from nozzles 4 serve the purpose of removal of deposits of solids from the external surfaces of pipe assembly 2 in the heat exchanger.

It is to be noted that the cleaning of very long vertical surfaces of the pipes can be carried out by a number of separate soot-blowing systems which can be switched on one after another to blow gases in the vertical direction. Reference number 22 designates additional feeding conduits which are provided in the event of an enhanced consumption of the blowing medium. Feeding conduits 22 can be uniformly spaced from each other along the pipe and open into feeding pipe 3. The arrangement of nozzles 4 extended between the tubes of tubular wall 1 is shown in FIG. 2*a*.

FIG. 3 depicts a feeding pipe 3, from which nozzle tube 11 terminated with a nozzle 12, is extended. Additional nozzles 14 are formed in tube 11, which are provided in two opposite walls of tube 11. Feeding pipe 3 is arranged behind the straight line that defines the external face of tubular wall 1 (pipe-to-pipe embodiment). Nozzle tube 11 in this embodiment branches off pipe 3 and penetrates through the wall 1 into the heat exchanger. As mentioned above one axial nozzle 12, from which streams of blowing gases are discharged into the interior of the heat exchanger, and two lateral nozzles 14 are provided at the end of tube 11. Streams of blowing gases 15 are discharged from nozzles 14 and are directed as well as streams 13 onto the surfaces of the pipe assembly 2 not shown in FIG. 3 and onto the inner side of tubular wall 1 to remove deposits of solid particles therefrom.

FIG. 3*a* shows the embodiment corresponding to that of FIG. 3 but with the tubular wall 1 of a pipe-web-pipe design. Webs 30 are provided between each two neighboring tubes of wall 1. Nozzle tube 11 having an end axial nozzle 12 and opposite lateral nozzles 14 similarly to those shown in FIG. 3 extends through an opening in web 30 into the interior of the heat exchanger.

Figure 4:
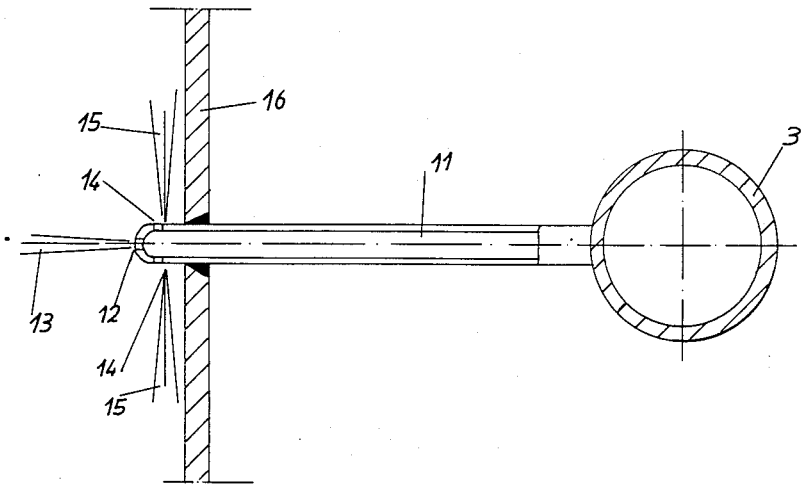
FIG. 4 is a partial sectional view of a soot blower with a smooth wall.

With reference to FIG. 4 it will be seen that in another modified embodiment a soot blower has a smooth or straight wall 16. The feeding pipe 3 for feeding a blowing medium into the heat exchanger or any other reaction vessel is arranged, similarly to the embodiment of FIG. 3, behind the wall 16 which is also formed outside the heat exchanger. The nozzle tube 11 branches off from feeding pipe 3. Tube 11, the head of which is provided with nozzles 12, 14, for blowing the medium onto the pipes of the heat exchanger, extends through wall 16.

Figure 5:
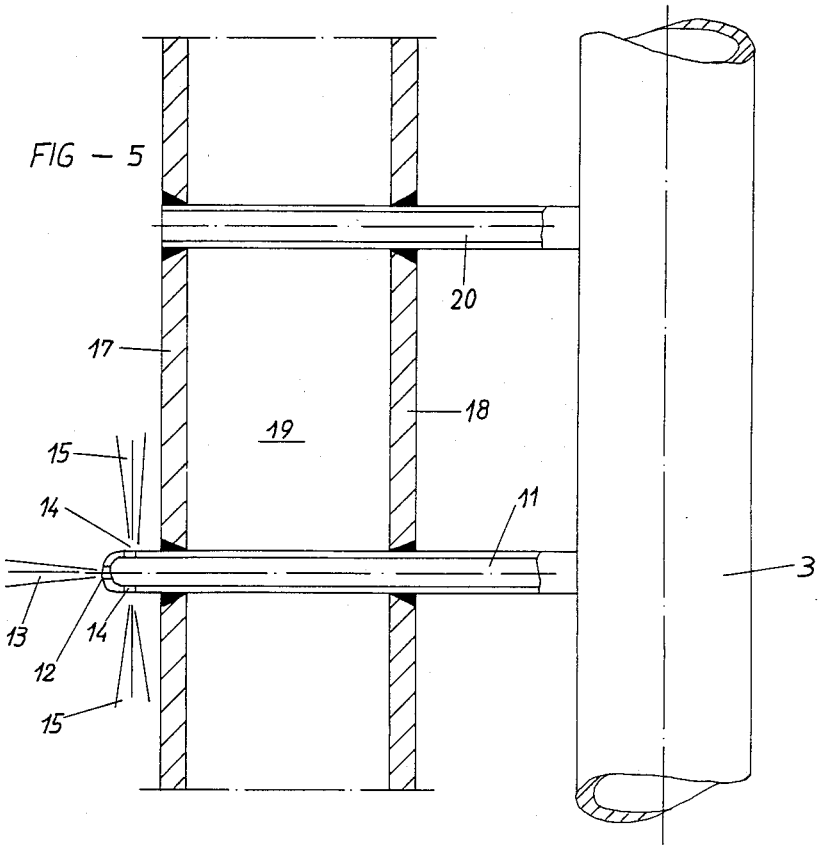
FIG. 5 is a partial sectional view of the soot blower with a smooth double wall.

FIG. 5 illustrates a further modification of the soot blower which has a smooth or straight double wall.

The inner wall 17 of the double wall is the wall which encloses the inner space of the heat exchanger whereas wall 18 is the external wall. The interspace 19 between walls 17 and 18 is filled with water which acts as a heat-receiving medium. The nozzle tube 11 branched off feeding pipe 3 has in this embodiment the design similar to those of FIGS. 3 and 4. A blowing medium tube 20 can be alternatively provided in this embodiment, the end face of tube 20 being flush with the inner face of wall 17. The embodiment shown in FIG. 5 makes it possible that cake deposits collected on wall 17 can be blown away upon an occasional operation of the soot blower.

Figure 6:
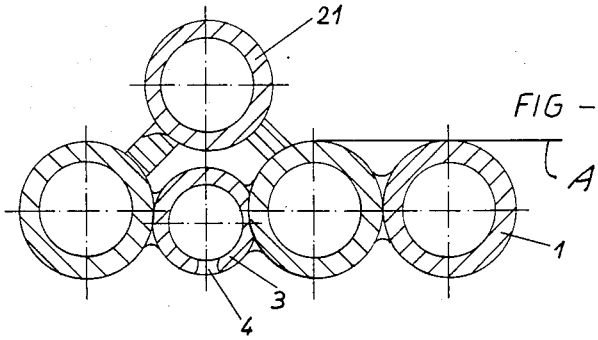
FIG. 6 is a sectional view through a feeding arrangement for a blowing medium, mounted within a tubular wall of the heat exchanger.

FIG. 6 illustrates still another embodiment of the soot blower in which the feeding pipe 3 provided with the nozzle 4 is interconnected between two adjacent tubes of wall 1. The connection of pipe 3 with the walls of two tubes of wall 1 can be carried out by welding. If necessary and due to safety requirements the tubular wall 1 interrupted by feeding pipe 3 can be closed, at the location of pipe 3, with a cooled tubular conduit 21. The latter can be connected to the tubes of wall 1 by suitable webs welded to the tubes of wall 1 and to conduit 21. In this embodiments each feeding pipe 3 integrated with wall 1 is located before the straight line of alignment A of all tube sections of wall 1.

The soot blower according to the invention has the following advantages:

1. The soot blower of the present invention is of a very simple construction and requires low manufacturing and assembling costs;

2. The soot blower requires no drive elements and no sealings and has no movable structural components which is the case in known soot blowers;

3. The present soot blower requires no energy for operating the blower;

4. The soot blower requires no special service;

5. No erosion or corrosion problems occur in the soot blower of the invention because the blower itself, due to the cooling by the walls of the heat exchanger, is not exposed to high temperatures;

6. The soot blower has practically unlimited service life;

7. No deformations due to heat effect occur in the soot blower;

8. Cleaning of vertical, horizontal and inclined surfaces of the heat exchanger is possible;

9. The introduction of the blowing agent into overheated zones presents no problems; and 10. An optimal arrangement of heat exchange surfaces is possible due to good cleaning possibilities of the heat exchange surfaces.

It will be understood that each of the elements described above, or two or more together, may also find a useful application in other types of soot blowers differing from the types described above.

While the invention has been illustrated and described as embodied in a soot blower for the removal of solid deposits from heat exchange surfaces of heat exchangers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A soot blower for the removal of deposits from walls of tubes positioned in an interior of a heat-exchanger, reaction vessel or the like, comprising means for feeding a blowing medium into said interior, said blower being integrated with said heat exchanger, said feeding means including a plurality of feeding pipes each having a nozzle tube directed into said interior and terminated with a nozzle open into the interior so as to direct and blow said blowing medium over said walls.

2. The blower as defined in claim 1, wherein said heat exchanger has an external wall having an outer face defined by a straight alignment line, said feeding pipes being positioned in the region of said alignment line.

3. The blower as defined in claim 2, wherein said feeding pipes are positioned before said alignment line as viewed from said interior.

4. The blower as defined in claim 3, wherein said external wall is formed of a plurality of adjacent tubes connected to each other, each nozzle being formed in said external wall.

5. The blower as defined in claim 2, wherein said feeding pipes are positioned behind said straight line as viewed from said interior.

6. The blower as defined in claim 5, wherein said external wall is formed of a plurality of adjacent tubes connected to each other, each nozzle tube extending through said external wall.

7. The blower as defined in claim 5, wherein said external wall is a straight wall, said feeding pipes being arranged outside of said wall and each including at least one said nozzle tube projected from the pipe and extended through said wall.

8. The blower as defined in claim 5, wherein said external wall is a double wall formed of two straight walls spaced from each other, said feeding pipes being arranged outside of said double wall and each including at least one said nozzle tube projected from the associated pipe and extended through said double wall.

9. The blower as defined in claim 8, wherein each feeding pipe is provided with an additional nozzle tube, one of the straight walls of the double wall having an inner face facing said interior, said additional nozzle tube having an end which is flush with said inner face.

10. The blower as defined in claim 8, wherein said nozzle tube partially extends into said interior.

11. The blower as defined in claim 2, wherein each of said feeding pipes has closeable discharge openings for blowing away solid particles collected in the pipes.

12. The blower as defined in claim 11, wherein each of said feeding pipes includes a plurality of feeding conduits, the number of said feeding conduits being selected in accordance with a requirement of blowing medium.

13. The blower as defined in claim 2, wherein the blowing medium is gas.

14. The blower as defined in claim 2, wherein the blowing medium is steam.

15. The blower as defined in claim 2, wherein said feeding pipes are arranged in series one after another in a vertical direction of the chamber.

16. The blower as defined in claim 15, wherein said feeding pipes are arranged in parallel with each other in a horizontal direction of the chamber.

* * * * *